US008299428B2

(12) United States Patent
Clark et al.

(10) Patent No.: US 8,299,428 B2
(45) Date of Patent: Oct. 30, 2012

(54) DETECTORS AND ION SOURCES

(75) Inventors: Alastair Clark, Dunstable (GB); Stephen John Taylor, Hyde Heath (GB); Robert Brian Turner, London (GB); Richard Turner, legal representative, London (GB); William Angus Munro, Watford (GB)

(73) Assignee: Smiths Detection-Watford Limited, Hertfordshire (GB)

( * ) Notice: Subject to any disclaimer, the term of this patent is extended or adjusted under 35 U.S.C. 154(b) by 326 days.

(21) Appl. No.: 12/595,014

(22) PCT Filed: Apr. 1, 2008

(86) PCT No.: PCT/GB2008/001153
§ 371 (c)(1),
(2), (4) Date: Jun. 21, 2010

(87) PCT Pub. No.: WO2008/125804
PCT Pub. Date: Oct. 23, 2008

(65) Prior Publication Data

US 2010/0276587 A1 Nov. 4, 2010

(30) Foreign Application Priority Data

Apr. 14, 2007 (GB) ..... 0707254.9

(51) Int. Cl.
*H01J 49/10* (2006.01)

(52) U.S. Cl. ..... 250/288; 250/285; 250/423 R

(58) Field of Classification Search ..... 250/288, 250/285, 423
See application file for complete search history.

(56) References Cited

U.S. PATENT DOCUMENTS

| | | | | |
|---|---|---|---|---|
| 6,225,623 | B1 | 5/2001 | Turner et al. | |
| 7,569,812 | B1 * | 8/2009 | Karpetsky et al. | 250/282 |
| 2002/0096631 | A1 * | 7/2002 | Andrien et al. | 250/288 |
| 2004/0069943 | A1 | 4/2004 | Kato | |

FOREIGN PATENT DOCUMENTS

| | | |
|---|---|---|
| EP | 1178307 | 2/2002 |
| WO | 2006107831 | 10/2006 |

* cited by examiner

*Primary Examiner* — Jack Berman
(74) *Attorney, Agent, or Firm* — Reinhart Boerner Van Deuren s.c.

(57) ABSTRACT

A field asymmetric ion mobility spectrometer (FAIMS) has an analyte ion source assembly by which an analyte substance is ionized and supplied to the inlet of the spectrometer. The ion source assembly has an upstream source of clean, dry air and two ion sources of opposite polarity arranged at the same distance along the flow path. The ion sources are arranged so that the overall charge of the plasma produced is substantially neutral. The analyte substance is admitted via an inlet downstream of the ion sources and flows into a reaction region of enlarged cross section to slow the flow and increase the time for which the analyte molecules are exposed to the plasma.

20 Claims, 1 Drawing Sheet

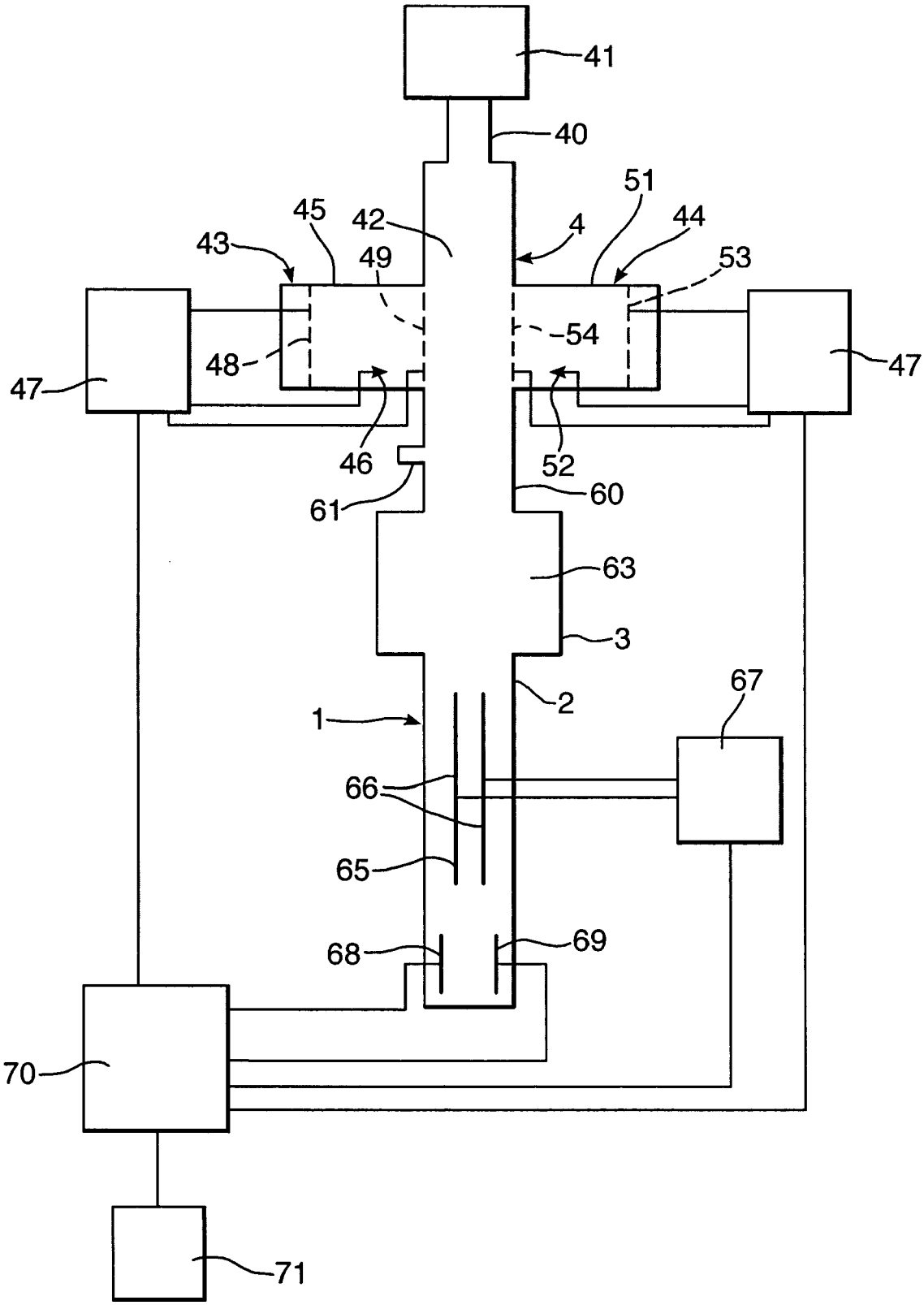
41
40
51
45
42
4
44
43
49
53
54
48
47
47
46
52
61
60
63
3
2
67
1
66
65
68
69
70
71

DETECTORS AND ION SOURCES

BACKGROUND OF THE INVENTION

Field of the Invention

This invention relates to ion source assemblies of the kind including a flow path having a mixing region along its length.

Detectors used to detect the presence of explosives, hazardous chemicals and other vapors, often include an ionization source to ionize molecules of the analyte before detection. In an ion mobility spectrometer, or IMS, the ionized molecules are admitted by an electrostatic gate into a drift region where they are subject to an electrical field arranged to draw the ions along the length of the drift region to a collector plate at the opposite end from the gate. The time taken for the ions to travel along the drift region varies according to the mobility of the ions, which is characteristic of the nature of the analyte. In a field asymmetric ion mobility spectrometer (FAIMS) or a differential mobility spectrometer (DMS), the ions are subject to an asymmetric alternating field transverse to the path of travel of the ions, which is tuned to filter out selected ion species and to allow others to pass through for detection.

Various techniques are commonly used for ionizing the analyte molecules. This may involve a radioactive source, a UV or other radiation source, or a corona discharge. U.S. Pat. No. 6,225,623, to Turner et al., describes an IMS with an ionization source having two corona point sources operated at different polarities. The point sources are arranged one after the other along the flow path of analyte molecules.

It is accordingly desirable to provide an alternative detector and ion source assembly.

SUMMARY OF THE INVENTION

According to one aspect of the present invention there is provided an ion source assembly of the above-specified kind, characterized in that the source includes first and second sources of positive and negative ions respectively opening into the mixing region to produce a plasma containing both positive and negative ions such that an analyte substance can be exposed to the plasma.

The first and second sources are preferably arranged such that the overall charge on the plasma is substantially neutral. The ion sources may include corona point ionization sources. The analyte substance is preferably introduced into the flow path at a location downstream of the ion sources. The assembly preferably includes a source of clean dry air opening into the flow path at a location upstream of the ion sources. The first and second sources preferably open into the flow path at the same distance along the length of the flow path. The first and second sources may include means to drive ions from the sources into the flow path. The means to drive the ions may include means to establish an electric field or/and may include a supply of gas, which may include a chemical species to enhance ion formation or tune the ion species formed. The mixing region preferably opens into a reaction region arranged to reduce the speed of flow within the reaction region. The cross-sectional area of the reaction region may be enlarged so as to reduce the speed of flow through it.

According to another aspect of the present invention there is provided a detector apparatus including an assembly according to the above one aspect of the present invention and a detector arranged to receive analyte ions from the assembly.

The detector is preferably a spectrometer such as an ion mobility spectrometer, such as a FAIMS spectrometer. The output of the detector may be used to control the flow of ions from the assembly.

DESCRIPTION OF THE DRAWINGS

A FAIMS detector apparatus that is constructed and operated according to the present invention will now be described, by way of example, with reference to the accompanying drawing, which shows the exemplary FAIMS detector apparatus schematically.

DETAILED DESCRIPTION OF THE PREFERRED EMBODIMENT

The apparatus includes a detector or analyzer unit 1 having its inlet end 2 connected to the outlet end 3 of an inlet ion source assembly 4, which provides a supply of ionized analyte molecules to the analyzer unit 1.

The inlet assembly 4 includes an inlet opening 40 at its upper end connected to a source 41 of clean, dry air, such as may be provided by a pump and a molecular sieve contained in the source 41 (an outlet for the air may be located at the distal end of the apparatus). The inlet opening 40 opens in-line into a mixing region 42. The inlet assembly 4 also includes two ion sources 43 and 44 that open into opposite sides of the mixing region 42 at the same longitudinal location or distance along the length of the flow path of gas admitted via the inlet opening 40.

The left-hand (as shown in FIG. 1), positive ion source 43 includes a chamber 45 containing a dual point corona 46 connected to a voltage source 47 operable to apply positive voltage pulses of about 3 kV to the dual point corona 46 which is effective to cause a corona discharge. Alternative ion sources are possible, such as a single point D.C. corona. The chamber 45 is relatively small and is selected to enable ready transfer of ions to the mixing region 42. The positive dual point corona 46 is located in the chamber 45 between two grids 48 and 49 which are respectively at voltages typically around +4 kV and +50 V. The lower voltage grid 49 is located at an opening of the chamber 45 into the mixing region 42. In this way, an electric field is established along the length of the chamber 45 that is effective to propel the positive ions created by the dual point corona 46 to the right (as shown in FIG. 1) and through the low voltage grid 49 into the mixing region 42.

Instead of, or as well as, using an electric field to propel the ions into the mixing region 42, it is possible to use a flow of gas to do so. Such a gas could include chemical species to enhance ion formation or to tune the ion species formed. This could be used to assist transfer of desired ion species to the central mixing region. The gas flow could be arranged to assist or counter the ion flow generated by an electric field.

Similarly, the right-hand (as shown in FIG. 1), negative ion source 44 includes a chamber 51 containing a dual point corona 52 connected with a voltage source 47 operable to apply negative voltage pulses of the same 3 kV magnitude to the dual point corona 52 which is effective to cause a corona discharge. Again alternative ion sources are possible, such as a single point D.C. corona. The chamber 51 is also relatively small and is selected to enable ready transfer of ions to the mixing region 42. The negative dual point corona 52 is located in the chamber 51 between two grids 53 and 54 which are respectively at voltages typically around −4 kV and −50 V. The lower voltage grid 54 is located at an opening of the chamber 51 into the mixing region 42. This establishes an electrical field along the length of the chamber 51 that is effective to propel the negative ions produced by the dual point corona 52 to the left (as shown in FIG. 1) and through the low voltage grid 54 and into the mixing region 42. Different chemical species could be introduced to the two ion sources 43 and 44.

The negative and positive ions thus enter the mixing region 42 at the same longitudinal location or distance along the length of the flow path through the inlet ion source assembly 4, thereby setting up a plasma containing a mixture of both positive and negative ions. Alternatively, the ions could instead enter the mixing region at different points. The overall charge on this plasma is neutral, thereby minimizing space-charge repulsion effects inside the apparatus. It will be appreciated, however, that the relative numbers of positive and negative ions and hence the overall charge on the plasma could be controlled to be other than neutral if desired. This could be achieved by altering the field within either or both of the ion sources 43 and 44.

The mixing region 42 opens directly into an analyte sample region 60 where the sample analyte is carried downstream with the plasma in the gas flow. The region 60 is shown as having an inlet 61 by which the analyte in the form of a gas or vapor is admitted to the region, such as via a membrane, a pin hole, a capillary or the like. Alternatively, the analyte sample could be in the form of a solid or liquid and could be placed in the analyte region via an opening (not shown).

The analyte region 60 communicates with an ion reaction chamber 63 having a larger cross-section than that of the analyte region 60 so that gas flow is reduced and the neutral analyte molecules have an increased residence time exposed to the plasma. It is not essential, however, to provide a region of larger cross-section. The reaction between the neutral analyte gas or vapor molecules and the plasma causes charged analyte species to be produced in the reaction chamber 63. These charged analyte species are then transferred to the analyzer unit 1 either by means of gas flow or by electrostatic means.

The analyte region 60 and/or the ion reaction chamber 63 may be configured to ensure that the plasma leaving these regions has a neutral charge balance. This may be achieved by allowing space charge repulsion forces a period of time to force excess ions of either polarity to neutralizing conductor surfaces.

The analyzer unit 1 may be of any conventional kind, such as including a drift region of an ion mobility spectrometer, or a spectrometer of the kind described in U.S. Pat. No. 5,227,628, to Turner. Two drift tubes or regions would be needed if the unit operated with both positive and negative ions. Alternatively, as illustrated, the analyzer unit may be provided by a Field Asymmetric Ion Mobility Spectrometer (FAIMS) or Differential Mobility Spectrometer (DMS) filter 65.

The filter 65 is provided by two closely-spaced plates 66 arranged generally parallel to the ion flow direction and connected to a filter drive unit 67 that applies an asymmetric alternating field between the two plates 66 superimposed on a DC voltage. By controlling the field between these plates 66, it is possible to select which ions are passed through the filter 65 and which are not. Two detector plates 68 and 69 at the far end of the analyzer unit 1 collect ions passed by the filter 65 and are connected to supply signals to a processor 70. The processor 70 provides an output indicative of the nature of the analyte substance to a display or other utilization means 71.

The response of the processor 70 may be used to alter the flow of ions from the ion sources (as shown by the control lines extending from the processor 70 to the voltage sources 47 respectively operating the chambers 45 and 51) so as to achieve the desired detection characteristics.

It will be appreciated that apparatus according to the invention could have alternative ion sources instead of corona points.

Although the foregoing description of the detectors and ion sources of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. An ion source assembly comprising:

a flow path having a mixing region along its length; and first and second sources of positive and negative ions respectively opening into the mixing region to produce a plasma containing both positive and negative ions such that an analyte substance can be exposed to the plasma.

2. An ion source assembly as defined in claim 1, wherein the first and second sources are arranged such that the overall charge on the plasma is substantially neutral.

3. An ion source assembly as defined in claim 1, wherein the ion sources include corona point ionization sources.

4. An ion source assembly as defined in claim 1, wherein the analyte substance is introduced into the flow path at a location downstream of the ion sources.

5. An ion source assembly as defined in claim 1, wherein the assembly includes a source of clean dry air opening into the flow path at a location upstream of the ion sources.

6. An ion source assembly as defined in claim 1, wherein the first and second sources open into the flow path at the same distance along the length of the flow path.

7. An ion source assembly as defined in claim 1, wherein the first and second sources include means to drive ions from the sources into the flow path.

8. An ion source assembly as defined in claim 7, wherein the means to drive the ions includes means to establish an electric field.

9. An ion source assembly as defined in claim 7, wherein the means to drive the ions comprises a supply of gas.

10. An ion source assembly as defined in claim 9, wherein the supply of gas includes a chemical species to enhance ion formation or tune the ion species formed.

11. An ion source assembly as defined in claim 1, wherein the mixing region opens into a reaction region arranged to reduce the speed of flow within the reaction region.

12. An ion source assembly as defined in claim 11, wherein the cross-sectional area of the reaction region is enlarged so as to reduce the speed of flow through it.

13. A detector apparatus comprising:

an ion source assembly as defined in claim 1; and a detector arranged to receive analyte ions from the ion source assembly.

14. A detector apparatus as defined in claim 13, wherein the detector is a spectrometer.

15. A detector apparatus as defined in claim 14, wherein the spectrometer is an ion mobility spectrometer.

16. A detector apparatus as defined in claim 13, wherein the detector is a field asymmetric ion mobility spectrometer ("FAIMS").

17. A detector apparatus as defined in claim 13, wherein the output of the detector is used to control the flow of ions from the assembly.

18. An ion source assembly comprising:

a mixing region having an inlet at a first end thereof and an outlet at an opposite second end thereof, the mixing region having first and second ion inlets located on opposite sides thereof at a location intermediate the first and second ends of the mixing region;

a first source of positive ions located in a first chamber having an outlet in communication with the first ion inlet in the mixing region;

a second source of negative ions located in a second chamber having an outlet in communication with the second ion inlet in the mixing region, wherein positive ions from the first chamber and negative ions from the second chamber mix to create a plasma of both positive and negative ions;

an analyte sample region having a first end in communication with the second end of the mixing region and an opposite second end, the analyte sample region having an analyte inlet located intermediate the first and second ends of the analyte sample region through which analyte samples enter; and an ion reaction chamber having a first end in communication with the second end of the analyte sample region and an opposite second end, the ion reaction chamber having a larger cross sectional area than the cross sectional area of the analyte sample region, an analyte entering the analyte inlet in the analyte sampling region reacting with the plasma of positive and negative ions in the ion reaction chamber to produce charged analyte species which exit the ion source assembly through the second end of the ion reaction chamber whereupon they may be analyzed.

19. A detector apparatus comprising:

an ion source assembly as defined in claim 18; and a detector arranged to receive analyte ions from the second end of the ion reaction chamber of the ion source assembly.

20. A method of operating an ion source assembly, comprising:

mixing positive ions from a first chamber and negative ions from a second chamber mix in a mixing region to create a plasma of both positive and negative ions, wherein the first and second chambers are located on opposite sides of the mixing region;

introducing an analyte sample into an analyte sample region located downstream from the mixing region; and reacting the analyte sample with the plasma of positive and negative ions in an ion reaction chamber located downstream from the analyte sample region to produce charged analyte species, wherein the ion reaction chamber has a larger cross sectional area than the cross sectional area of the analyte sample region.

* * * * *